United States Patent [19]

Minoura

[11] 4,282,846

[45] Aug. 11, 1981

[54] EXHAUST GAS RECIRCULATING DEVICE

[75] Inventor: Mikio Minoura, Nagoya, Japan

[73] Assignee: Aisan Industry Co., Ltd., Aichi, Japan

[21] Appl. No.: 64,261

[22] Filed: Aug. 6, 1979

[30] Foreign Application Priority Data

Aug. 23, 1978 [JP] Japan ..... 53-102606

[51] Int. Cl.[3] ..... F02M 25/06

[52] U.S. Cl. ..... 123/568

[58] Field of Search ..... 123/119 A, 568, 571

[56] References Cited

U.S. PATENT DOCUMENTS

| | | | |
|---|---|---|---|
| 2,419,747 | 4/1947 | Wassman | 123/119 A |
| 3,465,736 | 9/1969 | Daigh et al. | 123/119 A |
| 3,882,837 | 5/1975 | Horie et al. | 123/119 A |
| 3,983,854 | 10/1976 | August | 123/119 A |
| 4,100,734 | 7/1978 | Ozaki et al. | 123/119 A |
| 4,122,812 | 10/1978 | Takano | 123/119 A |
| 4,144,856 | 3/1979 | Tsukamoto | 123/119 A |
| 4,149,503 | 4/1979 | Ozaki et al. | 123/119 A |

FOREIGN PATENT DOCUMENTS

| | | |
|---|---|---|
| 50-3448 | 1/1975 | Japan . |
| 53-17830 | 2/1978 | Japan . |
| 53-72928 | 4/1978 | Japan . |
| 53-109018 | 9/1978 | Japan . |

*Primary Examiner*—Wendell E. Burns

[57] ABSTRACT

An exhaust gas recirculating device having a regulator integrally formed with an air horn of the carburetor, a throttle body and an insulator, both secured to a carburetor flange, a groove cut on the underside of the carburetor flange, a plate interposed between the flange and the suction manifold, said groove and plate forming an exhaust gas recirculating passage, a variable throttle valve, a throttle valve, and a link means interconnecting the variable throttle valve and the throttle valve, whereby exhaust gas from the engine is recirculated to downstream of the throttle valve. With this invention the exhaust gas recirculating device can be incorporated into conventional carburetors with minor modifications on the carburetor.

10 Claims, 4 Drawing Figures

EXHAUST GAS RECIRCULATING DEVICE

BACKGROUND OF THE INVENTION

This invention relates to an improvement in a device for reducing the quantity of NOx in the exhaust gas by recirculating the exhaust gas into the suction manifold in internal combustion engines.

The inventor of the present invention previously proposed an exhaust gas recirculating device for recirculating the exhaust gas (which shall be referred to as an EGR gas hereinafter) to a portion downstream of the throttle valve in the internal combustion engine. In this system, an EGR control valve and a variable throttle valve are provided in an EGR gas passage and the variable throttle valve is so arranged that its opening area varies in proportion to that of the throttle valve and that the pressure difference between the front and rear sides of the variable throttle valve is kept constant. However, the previous invention has the following disadvantages: the cost of special parts is high and the construction is complicated resulting in an increase in the assemblying processes. There have been increasing demands for an improved exhaust gas recirculating device that eliminates the above-mentioned drawbacks.

SUMMARY OF THE INVENTION

It is an object of this invention to provide an improved exhaust gas recirculating device which not only eliminates the afore-mentioned disadvantages but also is inexpensive and reliable in performing the exhaust gas recirculation function. It is another object of this invention to provide an improved exhaust gas recirculating device capable of being mass-produced.

To achieve the above objectives, an improved exhaust gas recirculating device comprises a regulator integrally formed with an air horn of the carburetor, a throttle body and an insulator, both secured to a carburetor flange, a groove cut on the underside of the carburetor flange, a plate interposed between the flange and the suction manifold, said groove and said plate both combining to form an exhaust gas recirculating passage and its delivery port, a variable throttle valve, a throttle valve, and a link means interconnecting said variable throttle valve and said throttle valve in such a manner that the throttle valve may close even when the variable throttle valve does not close.

DESCRIPTION OF THE PREFERRED EMBODIMENTS

Figure 1:
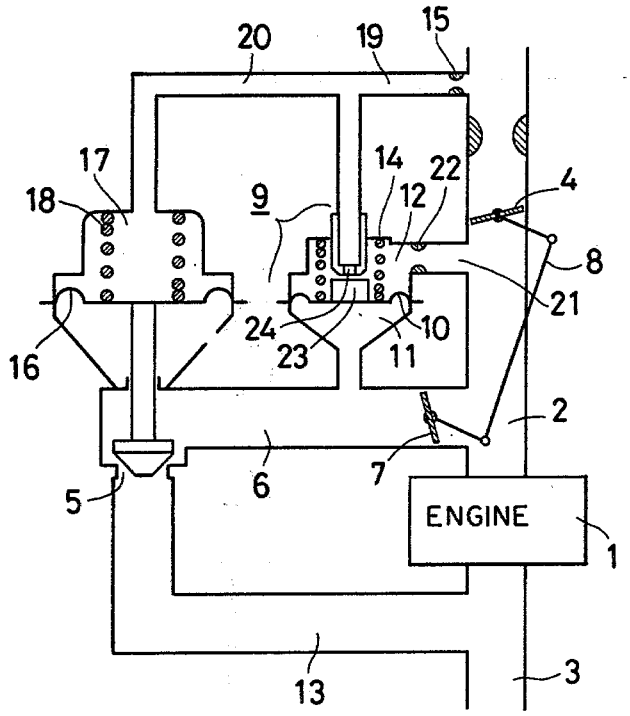
FIG. 1 is a schematic illustration showing overall construction of an improved exhaust gas recirculating device according to this invention.

Example embodiments of this invention will now be described with reference to the accompanying drawings. In FIG. 1, which illustrates an overall construction of an internal combustion engine, the quantity of air drawn into a suction manifold 2 of an engine 1 having an exhaust gas pipe 3 is controlled by a throttle valve 4. Exhaust gas is recirculated to the suction manifold 2 through a passage 13, an EGR valve 5, a passage 6 and a variable throttle valve 7. The variable throttle valve 7 and the throttle valve 4 are interconnected by a link 8 so that the opening ratio between these two valves is kept constant. A regulator 9 has two chambers divided by a diaphragm 10. One chamber in the regulator 9, or A-chamber 11, communicates with passage 6. The other chamber containing an open-close valve 23, or B-chamber 12, communicates with the area downstream of the throttle valve 4 of the suction manifold 2 via throttle 22 and a passage 21. The open-close valve 23 integral with the diaphragm 10 is biased by a spring 14 in the B-chamber to open. When the pressure in the A-chamber 11 becomes sufficiently high compared with that in the B-chamber, the diaphragm 10 moves against the force of the spring 14 to close a nozzle 24. The nozzle 24 leads to the atmosphere through a passage 19 and a throttle 15, and also communicates through a passage 20 to a diaphragm chamber 17 defined by a diaphragm 16 which actuates the EGR valve 5. The diaphragm chamber 17 contains a spring 18 which bears against the diaphragm 16 so that the EGR valve 5 secured to the diaphragm 16 is biased to close. The other chamber opposite to the diaphragm chamber 17 communicates with the open air.

Figure 2:
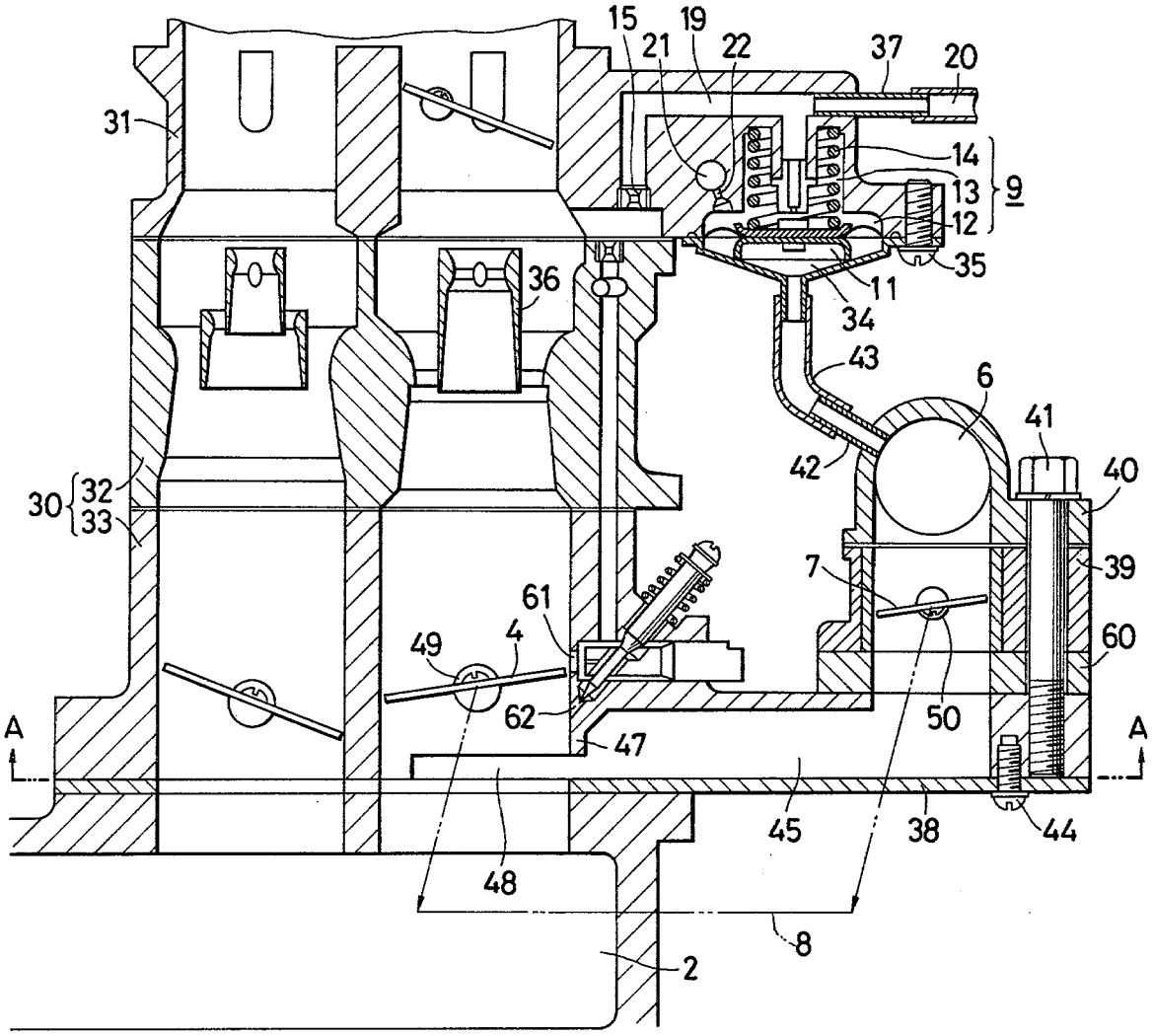
FIG. 2 is a vertical cross-sectional view of the improved exhaust gas recirculating device.
Figure 3:
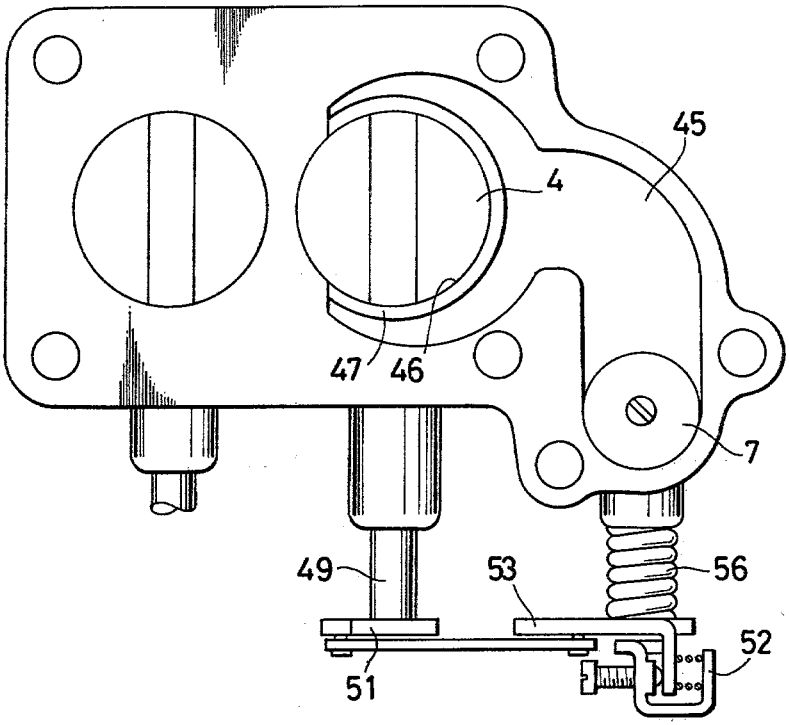
FIG. 3 is a cross-sectional view taken along the line A—A in FIG. 2.
Figure 4:
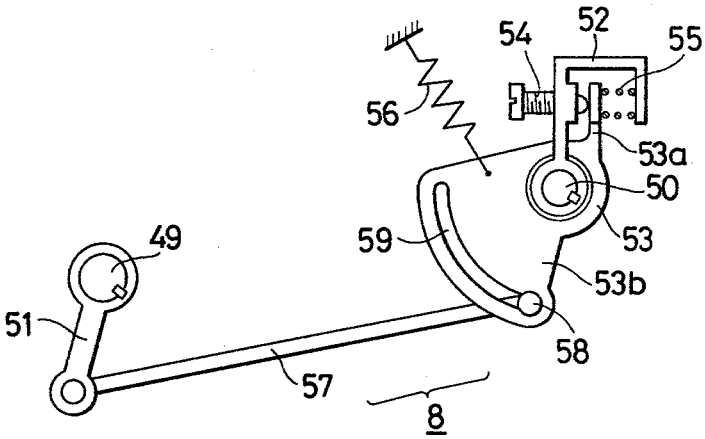
FIG. 4 illustrates the link connection between the throttle valve and the variable throttle valve.

Referring to FIGS. 2 through 4, the exhaust gas circulating device will be detailed in the following. A carburetor 30 comprises a horn 31, a body 32 and a flange 33, and is rigidly mounted on the suction manifold 2 through a plate 38. Formed in parallel with the suction air passage of the air horn 31 is a hollow portion which constitutes the B-chamber 12 of the regulator 9. The diaphragm 10 is secured by a cover 34 and screws 35 to the periphery of the hollow portion to form the A-chamber 11. The passage 19 formed in the air horn 31 opens upstream of a venturi 36. The throttle 15 is pressed against or threaded into the air horn 31. The throttle 22 is formed in the passage 21 which passes through the air horn 31, the carburetor body 32 and the flange 33 and opens downstream of the throttle valve 4 in the flange portion. The passage 19 is provided with a nipple 37 which is connected to the diaphragm chamber (not shown) or the EGR valve by a rubber pipe which forms the passage 20. The butterfly type throttle valve 4 is disposed in the suction air passage in the flange 33. A throw port 61 and an idle port 62 open to the suction air passage upstream and downstream of the throttle valve 4, respectively. An insulator 60, a variable throttle valve body 39 and an adaptor 40 are secured together and fixed to the flange 33 by a bolt 41 and they define a passage which extends therethrough from the passage 6 to a passage 45 thus forming a recirculating path. The passage 45 will be described later. The butterfly type variable throttle valve 7 is similar to the throttle valve body 39 and is connected with the throttle valve 4 by the link 8 in such a manner that their angles in a fully closed position are equal. The adapter 40 has a nipple 42 secured thereto and connected to the cover 34 through a rubber pipe 43. The adapter 40 is also connected with the passage 6 (not shown in more detail). The plate 38 clamped between the flange 33 and the suction manifold 2 is fixed to the flange by screws 44 so that a groove cut in the lower portion of the flange forms the passage 45 leading from the variable throttle valve 7 to downstream of the throttle valve 4 and serves as an exhaust gas recirculating path. The configuration of the passage 45 may be best illustrated in FIG. 3 showing the flange as viewed from below, with the plate 38 removed. The passage 45 is an L-shaped groove formed on the undersurface of the flange 33 and leads to an exhaust gas delivery port 48 formed between the plate 38 and the projection 47, the projection 47 being formed along the periphery of the bore 46 downstream of the throttle valve 4. The rotating shaft 49 of the throttle valve 4 is parallel to the rotating shaft 50 of the variable throttle valve 7 and they are interconnected by the link 8, whose construction may be best illustrated in FIG. 4. The rotating shaft 49 is secured to a first lever 51, and the rotating shaft 50 is secured to a second lever 52 of an inverse U-shaped configuration. A third lever 53 is rotatably supported on the rotating shaft 50, and is provided with a projection 53*a* and a plate 53*b* with the shaft 50 disposed therebetween. The projection 53*a* is held between a set screw 54 threaded into the inverse U-shaped portion of the second lever 52 and a spring 55 provided in the inverse U-shaped portion, so that the second lever 52 and the third lever 53 are rotated as one piece so long as the set screw 54 is not turned. The plate 53*b* has an arcuate groove 59 which has the same center as the rotating shaft 50. The first lever and the third lever are interconnected by a connecting rod 57 which is pivotally connected at one end with the first lever 51 and at the other end with the third lever through a pin 58 received in the arcuate groove 59. A rolled spring 56 around the shaft 50 is secured at one end to the third lever 53 and, through the second lever 52, urges the variable throttle valve 7 to close. When the variable throttle valve 7 does not close even by the action of the spring 56, the pin 58 will slide along the arcuate groove 59 allowing the connecting rod 57 and the first lever 51 to move freely so that the throttle valve 4 will close.

In the exhaust gas recirculating device constructed as above, the exhaust gas from the engine 1 is recirculated to the suction manifold 2 through the passage 13, the EGR valve 5, the passage 6, the variable throttle valve 7, the passage 45 and the delivery or exhaust port 48. The quantity of the EGR gas is determined by the opening area $A_1$ of the variable throttle valve 7 and the pressure difference $P_1-PB$ ($P_1$ is the pressure in the passage 6 and PB is the pressure in the suction manifold.) The quantity of the suction air is determined by the opening area $A_2$ of the throttle valve 4 and the pressure difference $P_2-PB$ ($P_2$ is the pressure in the area upstream of the throttle valve 4). Therefore, the ratio R in quantity of the EGR gas to the suction air is proportionate to $$\frac{A_1\sqrt{P_1-PB}}{A_2\sqrt{P_2-PB}}.$$

Since the regulator 9 controls the pressure in the diaphragm chamber 17 whose diaphragm 16 in turn actuates the EGR valve 5 so as to keep constant the pressure difference $P_1-PB$, and since the opening area ratio $A_1/A_2$ is kept constant by the link 8, the ratio R is determined only by the pressure difference $P_2-PB$.

To sum up, the exhaust gas recirculating device has the following features. Since the regulator 9 is integrally formed with the air horn 31 of the carburetor and the passages 19 and 21 are drilled in the horn 31, the number of parts can be reduced, which in turn reduces the assemblying time and cost. This also enables the throttles 15 and 22 to be maintained easily. Further, this construction not only makes the piping arrangement on the regulator simpler than than if it were to be formed as a separate component, but also reduces the possibility of a rubber tube coming off the regulator. The carburetor flange is grooved to form the passage 45 whose delivery port 48 opens downstream of both the throw port 61 and idle port 62, so that the height of the flange and therefore the overall height of the carburetor remain almost unchanged. Therefore, the exhaust gas recirculating device can be incorporated into the mass-produced conventional carburetor with minor modifications. Further, since the conventional suction manifold and air cleaner can be used with the device, it is possible to curb an increase in cost while improving the performance of the carburetor.

What is claimed is:

1. An exhaust gas recirculating device of an engine communicating with a suction manifold and having an exhaust pipe and having a carburetor and an exhaust gas recirculating passage leading from the exhaust pipe, comprising:

a throttle valve mounted in the carburetor, two valves comprising an exhaust gas recirculating EGR valve and a variable throttle valve, both of said two valves being disposed in the exhaust gas recirculating passage leading from the exhaust pipe of the engine, said exhaust gas recirculating passage leads to downstream of the throttle valve in the carburetor, said carburetor includes a carburetor flange, an insulator, a variable throttle valve body is secured said carburetor flange together with said insulator, a regulator means for being actuated by negative pressure downstream of the throttle valve of the carburetor for operating said EGR valve, said carburetor forms an air horn defining a suction air passage, said regulator means being formed integrally with said air horn of said carburetor, said air horn is formed with a bore forming a small air passage connecting said regulator means with said suction air passage of the air horn;

link means interconnecting said throttle valve and said variable throttle valve for keeping constant the ratio of the opening area between said throttle valve and said variable throttle valve and for controling the pressure difference between front and rear sides of the variable throttle valve to reduce Nox; and said carburetor flange being formed with a groove on an underside of the carburetor flange, a plate interposed between said carburetor flange and the suction manifold, said groove and said plate both cooperatively forming a portion of the exhaust gas recirculating passage and an exhaust gas delivery port opening into the suction manifold.

2. The device as set forth in claim 1, wherein said small air passage communicates with said EGR valve and connects said regulator means with said suction air passage.

3. The device as set forth in claim 1, wherein said regulator means is for controlling said EGR valve such that the pressure difference is constant between the suction manifold and a portion of said exhaust gas recirculating passage between said EGR valve and said variable throttle valve.

4. The device as set forth in claim 3, wherein said air horn and said carburetor flange form another passage communicating with the suction manifold downstream of the throttle valve of the carburetor, said regulator means comprises a diaphragm means for dividing said regulator means into a first chamber communicating with said exhaust gas recirculating passage between said EGR valve and said variable throttle valve and a second chamber communicating with said another passage, an open-close member connected to said diaphragm means, a nozzle in said second chamber is disposed cooperatively adjacent said open-close member, said nozzle communicates with said small air passage, and spring means for biasing said diaphragm means in a direction away from said nozzle.

5. The device as set forth in claim 4, further comprising first and second throttles formed in said air horn in said small air passage and said another passage, respectively.

6. The device as set forth in claim 5, wherein said EGR valve comprises a diaphragm actuated valve having two chambers, one of said two chambers communicates with said small air passage and the other of said two chambers communicates with atmosphere.

7. The device as set forth in claim 4, further comprising an adapter defining a portion of said exhaust gas recirculating passage between said EGR valve and said variable throttle valve, said adapter is connected to and communicates with said throttle valve body, said regulator means further includes a cover connected to said air horn securing said diaphragm means therebetween and forming with said diaphragm means said first chamber, a flexible pipe is connected to said cover and to said adaptor and communicates with said first chamber and said exhaust gas recirculating passage between said EGR valve and said variable throttle valve, bolt means for connecting said insulator, said variable throttle valve body and said adapter cooperatively together to said carburetor flange.

8. The device as set forth in claim 2, wherein said groove has an L-shaped configuration with said throttle valve and said variable throttle valve adjacent opposite ends of said groove.

9. The device as set forth in claim 2, wherein said carburetor flange is formed with a bore and a projection formed along the periphery of said bore, said throttle valve is disposed in said bore, said projection is spaced from said plate and forms therebetween said exhaust gas delivery port.

10. The device as set forth in claim 2, further comprising a first rotating shaft secured to said throttle valve and a second rotating shaft secured to said variable throttle valve, a first lever secured to said first rotating shaft and a second lever of inverted U-shape secured to said second rotating shaft, a third lever is rotatably mounted on said second rotating shaft, said third lever comprises a plate and a projection on opposite sides of said second rotating shaft, a set screw threaded into said second lever and abutting said projection, spring means mounted between said projection and said second lever, said plate is formed with an arcuate groove having said second rotating shaft as its center, an interconnecting rod is pivotally mounted on said first lever and has a pin moveably disposed in said arcuate groove, and a rolled spring means disposed around said second rotating shaft and secured to said third lever for biasing said variable throttle valve into a closing position.

* * * * *